United States Patent [19]

Makimoto et al.

[11] Patent Number: 4,631,506

[45] Date of Patent: Dec. 23, 1986

[54] FREQUENCY-ADJUSTABLE COAXIAL DIELECTRIC RESONATOR AND FILTER USING THE SAME

[75] Inventors: Mitsuo Makimoto, Yokohama; Haruyoshi Endo; Sadahiko Yamashita, both of Sagamihara, all of Japan

[73] Assignee: Matsushita Electric Industrial Co., Ltd., Kadoma, Japan

[21] Appl. No.: 514,262

[22] Filed: Jul. 15, 1983

[30] Foreign Application Priority Data

Jul. 15, 1982 [JP] Japan ..... 57-124085

[51] Int. Cl.[4] ..... H01P 7/04

[52] U.S. Cl. ..... 333/224; 333/226; 333/207

[58] Field of Search ..... 333/222, 223, 224–226, 333/219, 235, 227, 231, 232, 202, 206, 207, 175, 185; 331/96, 101, 102; 334/41

[56] References Cited

U.S. PATENT DOCUMENTS

| | | | |
|---|---|---|---|
| 2,245,138 | 6/1941 | Zottu | 334/41 X |
| 3,703,689 | 11/1972 | McAtee | 333/223 |
| 4,028,652 | 6/1977 | Wakino et al. | 333/235 X |
| 4,035,749 | 7/1977 | Slocum et al. | 333/232 |
| 4,342,972 | 8/1982 | Nishikawa et al. | 333/222 X |
| 4,398,164 | 8/1983 | Nishikawa et al. | 333/222 |
| 4,434,410 | 2/1984 | Miyake et al. | 333/224 |
| 4,506,241 | 3/1985 | Makimoto et al. | 333/222 |

FOREIGN PATENT DOCUMENTS

| | | | |
|---|---|---|---|
| 0141601 | 11/1981 | Japan | 333/223 |
| 0216809 | of 1968 | U.S.S.R. | 333/224 |

OTHER PUBLICATIONS

Uwano, Tomoki, "Ceramic-Filled Resonator Cuts Costs of Radio-Telephone Filters", *Electronics*, Jul. 14, 1983, pp. 129–131.

*Primary Examiner*—Eugene R. LaRoche
*Assistant Examiner*—Benny T. Lee
*Attorney, Agent, or Firm*—Cushman,Darby & Cushman

[57] ABSTRACT

A coaxial dielectric resonator for VHF and/or UHF band comprising a generally cylindrical dielectric having inner surface and outer surface. The inner and outer surfaces of the dielectric are respectively covered by outer and inner conductors and these conductors are connected at one end of the dielectric. An adjusting screw for adjusting resonance frequency is provided at the other end of the dielectric which is covered by a lid while holding a gap between the adjusting screw and the lid. A microwave filter using a plurality of the coaxial dielectric resonator is further described.

1 Claim, 7 Drawing Figures

FREQUENCY-ADJUSTABLE COAXIAL DIELECTRIC RESONATOR AND FILTER USING THE SAME

BACKGROUND OF THE INVENTION

This invention relates generally to a coaxial dielectric resonator of the TEM mode for VHF and/or UHF band, and more particularly to such resonators which are small in size, providing high Q.

Recently, intensive research for miniaturizing filters and resonators used in VHF and/or UHF band and raising efficiency thereof has been carried on. For this purpose, it is earnestly expected to realize a small resonator having high Q (low loss).

As a small resonator for VHF and/or UHF band, there is known a quarter wavelength coaxial dielectric resonator. This conventional resonator comprises coaxially arranged cylindrical outer and inner conductors and having a dielectric filled in the space between the outer and inner conductors. One end of the outer and inner conductors is shorted together by a shorting conductor, and at other end of the inner conductor, an electrode for adjusting the resonance frequency of the resonator is mounted. The dielectric with outer, inner and shorting conductors is inserted into a case and convered by a lid on which an adjustable screw is mounted for adjusting resonance frequency with the electrode.

The above-mentioned conventional resonator has been shortened in length as expressed by $1/\sqrt{\epsilon r}$, wherein $\epsilon r$ is the specific inductive capacity of the dielectric used. The resonance frequency of the resonator is adjusted by varying a gap distance between the electrode and the screw which constitute a capacitor.

However, in the resonator, the screw is mounted at outside of the lid so that the loss of space is unavoidable when the resonator is assembled in an apparatus. Furthermore, the resonance frequency is made variable by varying the gap distance because of the screw touching other parts of the apparatus.

In addition, when a filter is assembled by the use of the resonator, especially when stepped impedance type is used, unnecessary resonance is apt to occur because of unsufficient ground of the resonator.

SUMMARY OF THE INVENTION

It is, therefore, an object of the invention to provide a new and useful coaxial dielectric resonator for VHF and/or UHF band, which resonator does not have adjusting means at outside of the resonator.

It is another object of the present invention to provide a filter without unnecessary resonance.

According to the present invention, there is provided a coaxial dielectric resonator comprising a generally hollow cylindrical dielectric having inner and outer surfaces, an inner conductor attached to the inner surface of the dielectric, an outer conductor attached to the outer surface of the dielectric, a conductor for connecting the inner and outer conductors attached to one end surface of the dielectric, and an adjusting means for adjusting the resonance frequency of the resonator disposed at another end portion of the dielectric in connection with the inner conductor.

According to the invention, there is also provided a microwave filter comprising a plurality of coaxial dielectric filters and a metal block having apertures to which the resonators are inserted. The resonator comprises a generally hollow cylindrical dielectric having a thick portion, a thin portion and a stepped portion interposed between the thick and thin portions, an inner conductor attached to the inner surface of the dielectric, an outer conductor attached to the outer surface of the dielectric, a conductor for connecting the inner and outer conductors attached to one end surface of the dielectric, and an adjusting means for adjusting the resonance frequency of the resonator disposed at another end portion of the dielectric in connection with the inner conductor.

BRIEF DESCRIPTION OF THE DRAWINGS

The invention will be further described with reference to the accompanying drawings, in which.

The same or corresponding elements and parts are designated as like reference numerals throughout the drawings.

DETAILED DESCRIPTION OF THE INVENTION

Figure 1A:
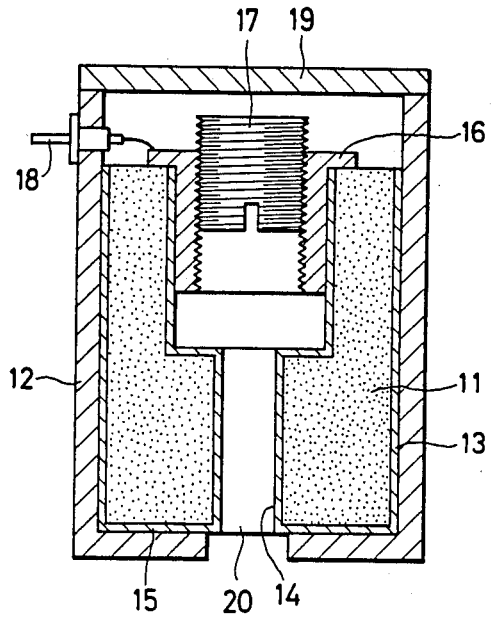
FIG. 1A is a schematic cross-sectional view of a first embodiment of the coaxial dielectric resonator according to the present invention.
Figure 1B:
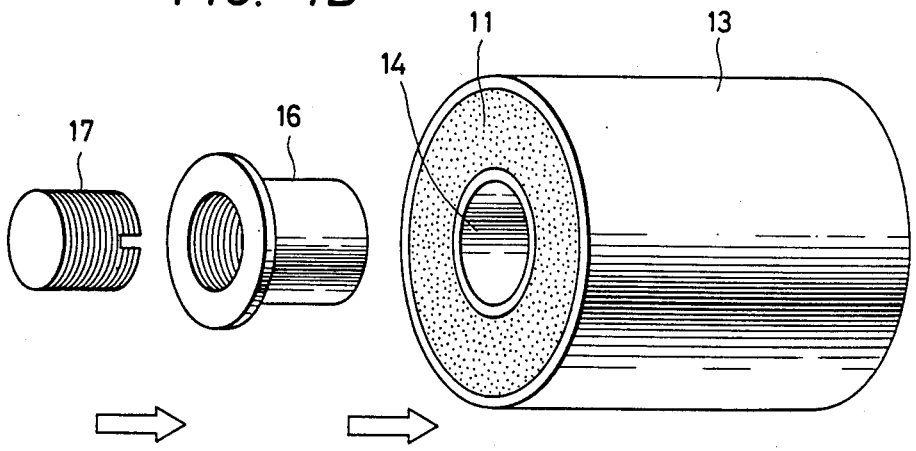
FIG. 1B is a perspective view of parts illustrated in FIG. 1A.

Referring to FIGS. 1A and 1B, a generally hollow dielectric 11 is provided in a casing 12 having an aperture 20 at the bottom. The dielectric 11 has thick portion, thin portion and stepped portion interposed between the thick portion and thin portion. The dielectric 11 is metalized on the outer surface, the inner surface and the end surface of the thick portion to form outer conductor 13, inner conductor 14, and short-circuit conductor 15 for connecting the outer conductor 13 and inner conductor 14. At the open end portion of the inner conductor 14, a metal cylinder 16 having a female screw at the inside thereof is mounted and a male screw 17 is inserted into the female screw of the metal cylinder 16. The metal cylinder 16 has a flange at the top thereof as illustrated in FIG. 1B and inserted into the dielectric 11 in contact with the inner conductor 14. The flange of the metal cylinder 16 is coupled to the external circuit via a connector 18.

On the top of the casing 12, a lid 19 of metal is fixed so as to form a gap between the male screw and the lid. The screw 17 is rotatable with a screw driver via the aperture 20 at the bottom of the casing 12. By rotating the screw 17, the gap distance between the screw 17 and the lid 19 is varied to change the capacitance formed at the gap. As a result, the resonance frequency of the resonator can be adjusted freely.

In FIG. 1A, the dielectric 11 has the thick, thin and stepped portion and thereby the inner conductor 14 has portions of different diameters. However, it is possible to use dielectric having straight inner surface and straight inner conductor of same diameter.

The resonator mentioned above has no projections at outside thereof. Therefore, the loss of space is avoided when assembled in the apparatus, and no fluctuations of resonance frequency is observed because the frequency adjusting screw does not touch elsewhere.

Figure 1C:
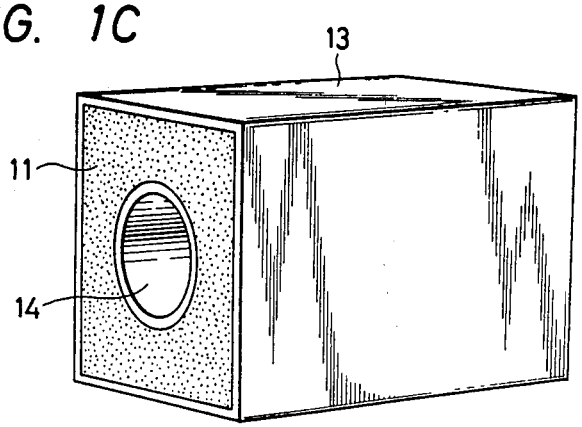
FIG. 1C is a perspective view of another embodiment of dielectric for use in the resonator of FIG. 1A.

FIG. 1C shows an another embodiment of the dielectric 11 of the resonator shown in FIG. 1A. This dielectric 11 has a rectangular periphery. Other parts and operations thereof are the same as those of the dielectric 11 shown in FIGS. 1A and 1B.

Figure 2A:
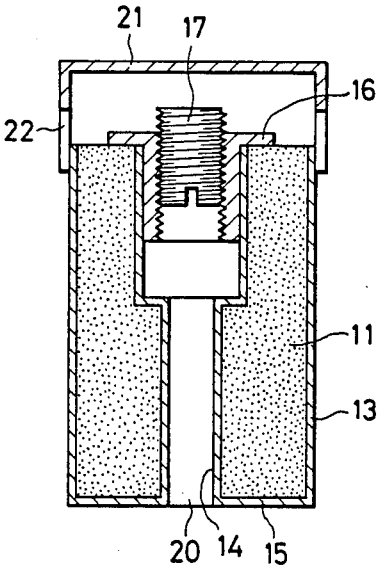
FIG. 2A is a schematic cross-sectional view of a second embodiment of the coaxial dielectric resonator according to the present invention.
Figure 2B:
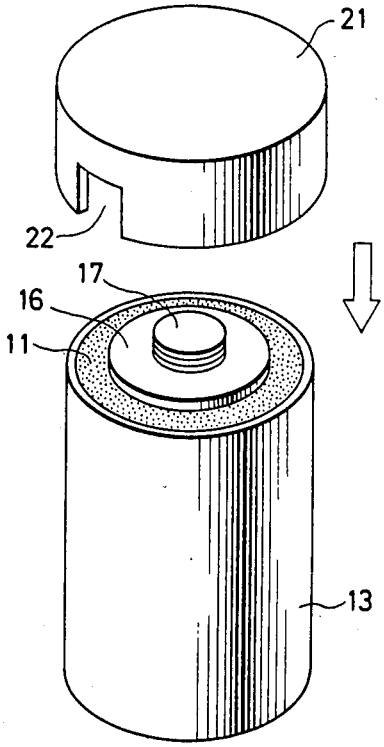
FIG. 2B is a perspective view of the resonator of FIG. 2A.

Referring now to FIGS. 2A and 2B, a generally hollow dielectric 11 has thick portion, thin portion and stepped portion interposed between the thick portion and thin portion. The dielectric 11 is metallized on the outer surface, the inner surface and the end surface of the thick portion to form outer conductor 13, inner conductor 14, and short circuit conductor 15 for connecting the outer conductor 13 and inner conductor 14. At the open end of the inner conductor 14, a metal cylinder 16 having a female screw at inside thereof and a flange at the top thereof is mounted in connection with the inner conductor 14. A male screw 17 for adjusting resonance frequency is inserted into the female screw of the metal cylinder 16.

The above-mentioned parts and operations of the resonator shown in FIGS. 2A and 2B are the same as those of the resonator shown in FIGS. 1A and 1C. A cap 21 having a recess 22 at side wall thereof is mounted at the top of the dielectric 11 having outer and inner conductors 13 and 14 by solder or conductive binding agent. A gap for adjusting resonance frequency is formed between the male screw 17 and the bottom of the cap 21. The recess 22 is used for connecting or coupling other electric parts or circuits. The resonator of FIGS. 2A and 2B has further advantages to lighten the weight and to make simple construction in comparison with the resonator of FIGS. 1A to 1C.

Figure 3:
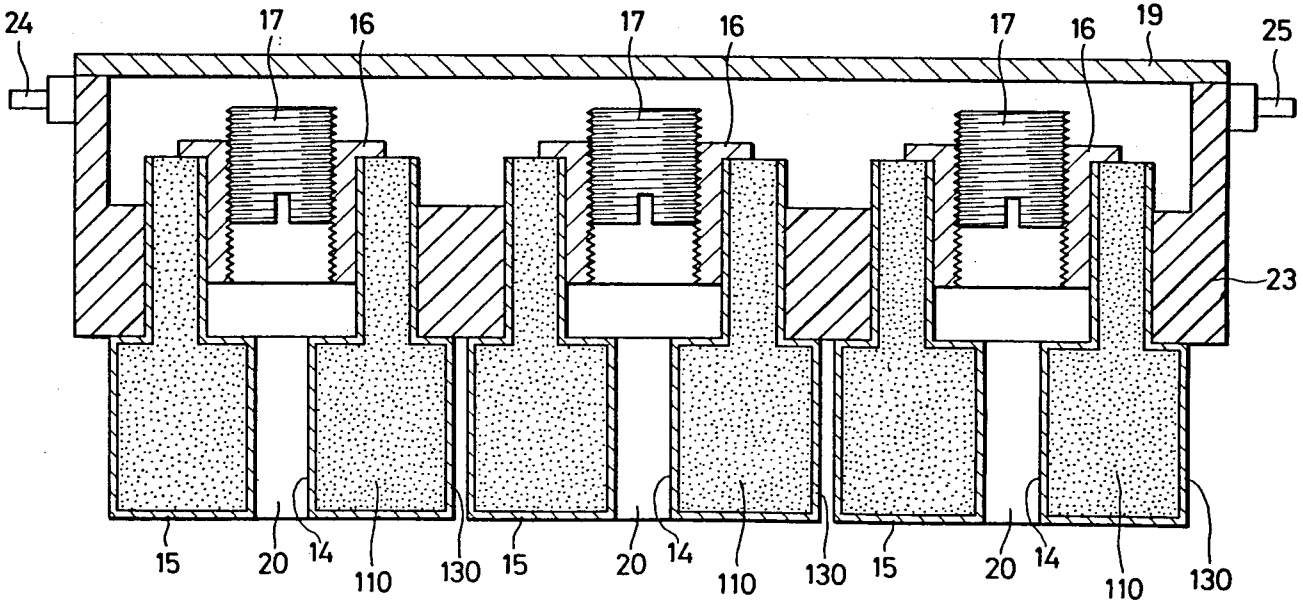
FIG. 3 is a schematic cross-sectional view of an embodiment of a filter according to the present invention.

Referring now to FIG. 3, a filter for VHF and/or UHF band is provided by using a plurality of the resonators previously described. In the embodiment, these coaxial dielectric resonators are used. Each part of the resonators except the dielectric 110 and the outer conductors 130 is similar to that of the resonator shown in FIGS. 1A to 1C or FIGS. 2A to 2B.

Figure 4:
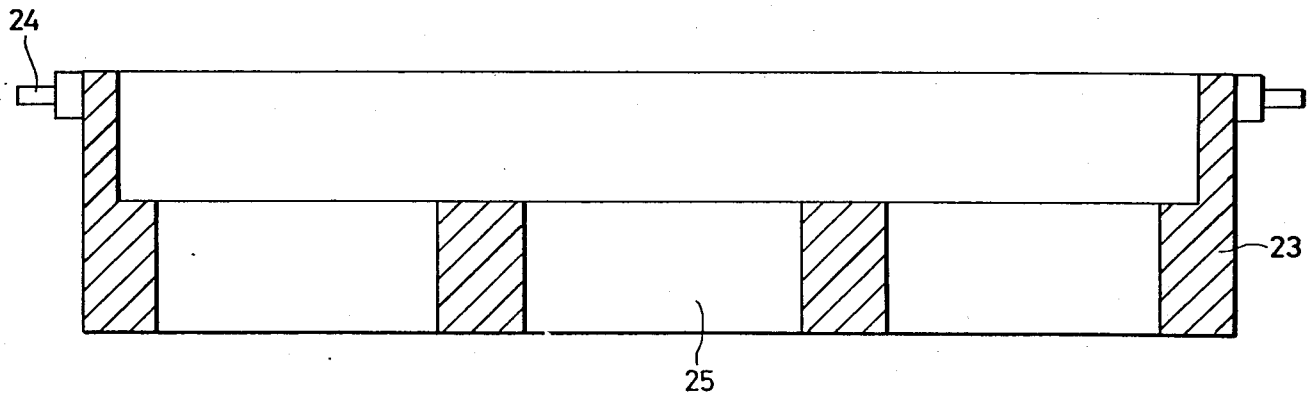
FIG. 4 is a schematic cross-sectional view of an embodiment of a metal block for use in the filter of FIG. 3.

The dielectric 110 is different from the dielectric 11 of FIGS. 1A to 1C or FIGS. 2A to 2B in its configuration. Namely, the dielectric 110 has stepped portion at both sides of inner surface and outer surface. Because of the configuration of the dielectric 110, the outer conductor 130 has a stepped configuration in the same manner as the inner conductor 14. All the resonators are inserted into apertures of a metal block 23. As illustrated in FIG. 4, the metal block 23 has apertures 25 for receiving therein resonators to fix the resonators with each other. An input connector 24 and an output connector 25 are provided at periphery of the metal block 23 each coupled to the flange of the metal cylinder 16. On the top of the metal block 23, a lid 19 of a metal is attached to form the capacitive gaps between the male screws 17. Each of the flanges of the metal cylinder 16 is coupled with each other. In this construction, the resonators are tightly mounted by the metal block 23 and perfect ground is performed by the metal block 23, whereby unnecessary resonance such as spurious resonance are suppressed. Furthermore, it is possible to assemble filters with a small number of parts.

In FIG. 3, each of the dielectric 110 has a stepped outer surface. However, the dielectric having straight outer portion like that shown in FIGS. 1A to 1C and FIGS. 2A to 2B is also applicable to the filter of the invention.

What is claimed is:

1. A coaxial dielectric resonator comprising:

a longitudinally extending hollow dielectric member having two ends and longitudinally extending cylindrical inner and outer surfaces extending between the two ends;

an inner hollow conductor disposed on said cylindrical inner surface extending between the two ends forming a longitudinally extending passage therethrough;

an outer conductor disposed on said cylindrical outer surface extending between the two ends, said outer conductor also extending across one of the two ends to contact said inner conductor to form a short-circuit end;

a third, hollow cylindrical conductor having a threaded inner surface and an outer surface contacting said inner conductor adjacent the other of the two ends of said hollow dielectric member;

a fourth, cylindrical conductor having a threaded circumference engaging the threaded inner surface of said third conductor, the fourth conductor having means adapted to be engageable through said passage with an adjustment tool by which the position of the fourth conductor is longitudinally adjustable, said engageable means being located inwardly from said short-circuit end;

a fifth conductor contacting said outer conductor and longitudinally spaced from said fourth conductor to form a capacitive coupling therewith; and wherein said inner surface of the dielectric has a small diameter portion and a large diameter portion defining a stepped shoulder therebetween, said third conductor being accommodated in said large diameter portion.

* * * * *